US008007343B1

(12) United States Patent
Komsky

(10) Patent No.: US 8,007,343 B1
(45) Date of Patent: Aug. 30, 2011

(54) BUST SUPPORT

(76) Inventor: Irena Komsky, Danville, CA (US)

( * ) Notice: Subject to any disclaimer, the term of this patent is extended or adjusted under 35 U.S.C. 154(b) by 322 days.

(21) Appl. No.: 12/218,560

(22) Filed: Jul. 16, 2008

Related U.S. Application Data

(60) Provisional application No. 60/959,705, filed on Jul. 16, 2007.

(51) Int. Cl.
*A41C 3/00* (2006.01)

(52) U.S. Cl. ..... 450/54; 450/57; 450/1; 2/268

(58) Field of Classification Search ..... 2/104, 73, 2/78.1–78.4, 46, 92, 455, 267, 268, 1; 602/6; 623/7, 8; 450/53–58, 1, 36–39, 41–45
See application file for complete search history.

(56) References Cited

U.S. PATENT DOCUMENTS

| | | | | |
|---|---|---|---|---|
| 3,135,961 | A | 6/1964 | Roderick | |
| 3,311,112 | A * | 3/1967 | Murray | 450/1 |
| 3,619,819 | A * | 11/1971 | Mann | 623/7 |
| 5,083,555 | A * | 1/1992 | Lewis | 602/6 |
| 5,807,160 | A * | 9/1998 | Wehmeyer | 450/57 |
| 6,095,894 | A * | 8/2000 | Stevens | 450/57 |
| 6,102,772 | A * | 8/2000 | Fernandez | 450/1 |
| 6,769,955 | B1 * | 8/2004 | Fisher | 450/54 |
| 7,001,239 | B2 * | 2/2006 | Russell | 450/57 |
| 7,144,295 | B2 * | 12/2006 | Fisher | 450/54 |
| 7,445,541 | B2 * | 11/2008 | Patterson | 450/54 |

* cited by examiner

*Primary Examiner* — Gloria Hale
(74) *Attorney, Agent, or Firm* — Larry D. Johnson

(57) ABSTRACT

A bust support device utilizing a pillow member having a top, a bottom, and a pair of curving side portions to permit the pillow to be placed in the cleavage area of the bust. The side portions adjoining the bottom of the pillow underlie the breasts. The pillow may be supported to a garment worn by the user, or directly to the torso of the user by a pair of straps.

5 Claims, 2 Drawing Sheets

BUST SUPPORT

CROSS REFERENCE TO RELATED APPLICATIONS

The present application claims the benefit of the filing date of U.S. Provisional Patent Application Ser. No. 60/959,705, filed Jul. 16, 2007.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to clothing articles and undergarments, and more particularly to an improved bust support apparatus for supporting the bust on the torso of a subject.

BACKGROUND INFORMATION AND DISCUSSION OF RELATED ART

Breast enlargement due to pregnancy, nursing, breast enlargement surgery, premenstrual symptoms and the like may cause discomfort when a woman lies in a side position. In addition, wrinkles tend to develop in the cleavage area between a woman's breasts due to aging, extensive exercising, the aftermath of a pregnancy, and the like. Such wrinkles become visible and are deemed to be unsightly. It is believed that the appearance of such wrinkles is also accelerated by sleeping without a bra for reasons of comfort. For example, when a woman lies sideways in a sleeping position, gravity tends to create wrinkles in the cleavage area of the bust. When engaging in athletics, special sports bras force the breasts of a woman closer to the body in order to avoid injury. However, such positioning of the breasts may also exacerbate the formation of wrinkles in the cleavage area.

U.S. Pat. Nos. 3,135,961 and 3,257,666 describe pads which are used in garments to protect the user during athletic endeavors.

U.S. Pat. Nos. 147,264; 2,505,720; 5,716,255; 5,823,852; and 5,971,834 show bras which include pads and supports to add comfort to the user of the same.

U.S. Pat. No. 5,662,512 shows a brassiere with rigid or stretched support in the cleavage area between the breasts of the user to aid in postural support or to prevent inter-mammary wrinkles.

U.S. Pat. No. 5,807,160 to Wehmeyer discloses a cleavage wrinkle protector constructed of satin or similar lingerie type fabric and stuffed with polyester fiberfill. The protector includes stretch lace neck and torso straps. The protector is approximately 6½ inches long and 2½ inches wide. The protector is designed to be worn between the woman's breasts while sleeping to protect the cleavage skin from folding when she lies on her side.

U.S. Pat. No. 6,095,894 to Stevens describes a pillow-like protector and body support device having a central section stuffed with polyurethane and covered with soft hypoallergenic material and provided with cut-away air gaps and medial seams that form air grooves or channels. The pillows and supports are made for supporting various body parts, e.g., the neck, shoulder, torso, elbows, and tailbone. Many of the pillows/supports are capable of being used together into an integrated system for alleviating bedsores and other medical problems associated with sitting or lying in the same position for long periods of time. One embodiment of the invention relates to a coccyx protector and is adapted to slip over a bedpan. In addition, embodiments are disclosed related to breast supports. One version is a small pillow/protector with an airflow pocket. Another version is sling-like and includes an air circulation seam for the skin just beneath the pillow. Yet another version of the breast support is for protecting both breasts. Several airflow seams are provided transversely across the pillow to provide ambient air access to the breasts. A cutout enables ventilation of the torso near the base of the sternum. Straps are included to secure the same to the patient with minimum discomfort.

U.S. Pat. No. 6,102,772 to Fernandez teaches an anti-wrinkle brassiere specially designed for night use and as an element for preventing inter-mammary wrinkles. It is also a protection element for the back, the dorsal vertebra and it avoids back pains. It has a front portion which covers its inter-mammary zone and it prolongs on two oblique straps which are joined to the back portion, preventing the breasts to be joined. The straps which only cover the shoulder part form lateral arches which deviate from the line marked by the day brassiere, for good lymphatic drainage. It remains fastened to the skin and its inferior border is located at few centimeters under the conventional brassieres.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides a novel and useful support device for the bust on the torso of a subject, which is both comfortable and firmly positioned. The support device of the present invention utilizes a pillow member having a casing forming a chamber for accommodating a filler material within the chamber. The pillow includes a top, a pair of curved side portions oriented to curve in opposite orientation from one another, and a bottom. The top, side portions, and bottom form the perimeter of the pillow such that a part of each of the side portions underlies each of the breasts of the bosom or bust of the subject when in use.

The pillow member may include support means to directly hold the same to the torso of the user. In such a case, a pair of straps may be employed fastened at four points to the pillow to allow the same to criss-cross on the back of the torso of the subject. The pillow may also be formed with four corners terminating at the extremities of the top and bottom of the pillow structure. In such a configuration, the pair of straps would each be attached to opposite corners of the pillow for achieving a criss-cross support on the torso of the subject.

In yet another embodiment of the present invention, the pillow may include support means directly connected to the outer surface of the casing. Such support means would interact with a garment, such as a sports bra, having a complementary fastening means. For example, such fastening means may take the form of hook and loop fasteners, adhesive material, clasps, snaps, and the like.

It is therefore an object of the present invention to provide a support device for the bust of a torso of a subject which may be comfortably used by a subject during multiple activities.

Another object of the present invention is to provide a support device for the bust on the torso of a subject which easily fastens to an existing garment such as a sports bra for use with the same during sports activities.

Another object of the present device is to provide a support device for the bust on the torso of a subject which prevents wrinkles in the cleavage area of the bust.

Another object of the present invention is to provide a support device for the bust on the torso of the subject which may be employed by a person to sleep without discomfort.

A further object of the present invention is to provide a support device for the bust on the torso of a subject which prevents the breasts from being pushed together, and, thus, prevents wrinkles from occurring in the cleavage area.

An even further object of the present invention is to provide a novel bust support which may be employed by a woman during pregnancy, during nursing, following breast augmentation surgery, and during premenstrual conditions.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
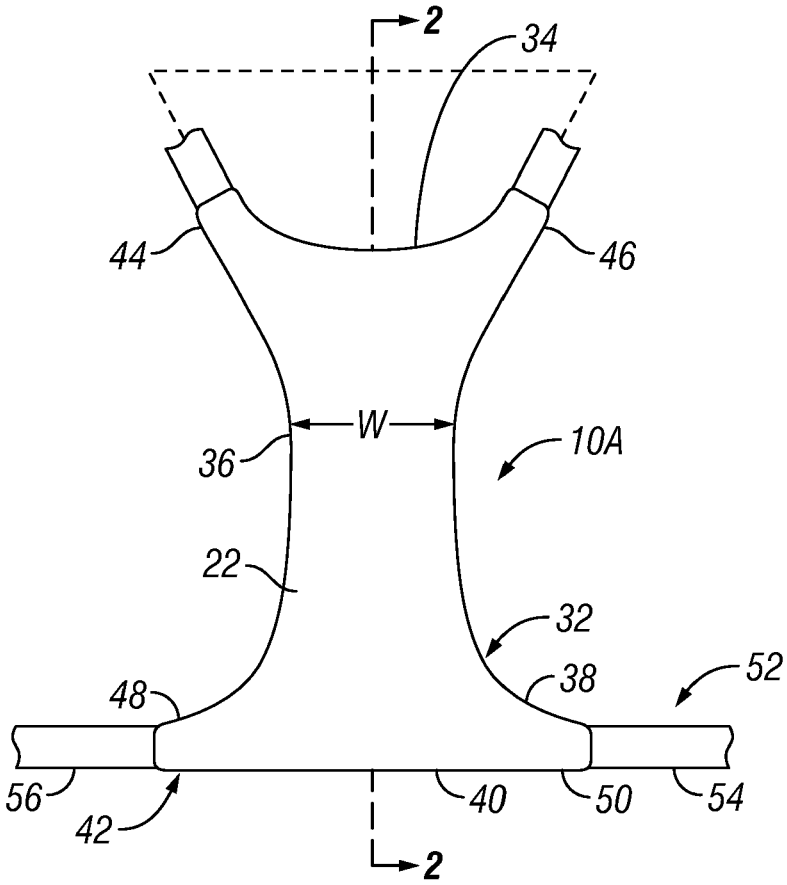
FIG. 1 is a front elevational view of a first embodiment of the bust support of the present invention depicting a quartet of straps in portion.

Referring to FIGS. 1 through 4, wherein like reference numerals refer to like components in the various views, there is illustrated therein a new and improved bust support, generally denominated 10 herein.

Figure 2:
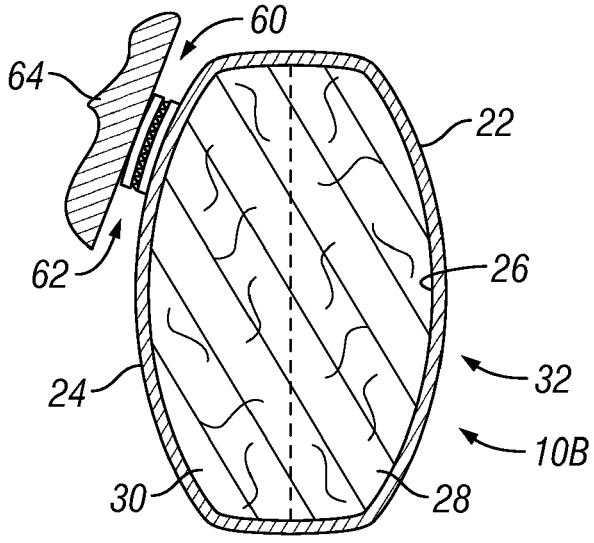
FIG. 2 is a sectional view taken along line 2-2 of FIG. 1 and also illustrating a second embodiment of the present invention.

FIG. 1 illustrates a first preferred embodiment of a support device 10A for use in conjunction with the bust 12 on the torso 14 of a subject 16. Bust 12 includes breasts 18 and 20. With further reference to FIG. 1, it may be observed that device 10A includes a casing 22, preferably constructed of polyester lycra, cotton polyester, or other suitable material. FIG. 2 shows casing 22 as having an outer surface 24 and an inner surface 26. Casing 22 forms a chamber 28 which accommodates a filler 30 of soft material. The material of filler 30 may take the form of cloth, down, polyester stuffing, liquid based materials, and the like. The chamber 28 may also be inflated with a gas. In the preferred embodiment depicted in FIG. 2, filling 30 is in the form of a sponge material.

Returning again to FIG. 1, it may be seen that casing 22 and filler 30 forms a pillow 32. Pillow 32 possesses a top 34, a pair of side portions 36 and 38, and a bottom 40. It should be apparent that bottom 40 may be wider than top 34. It should be understood that top 34 and side portions 36 and 38 may extend upwardly in FIG. 1 as described (dashed lines). In any case, top 34, side 36, side 38 and bottom 40 form a perimeter 42 of pillow 32. In the embodiment depicted in FIG. 1, perimeter 42 possesses corners 44, 46, 48, and 50.

Bottom 40 of the pillow 32 is preferably substantially wider than the narrowest width W between sides 36 and 38, for better fit and to provide additional support beneath the breasts, especially when the woman is sitting, standing, walking, or otherwise upright. Top 34 of the pillow 32 is also preferably substantially wider than the narrowest width W between sides 36 and 38, to contour to the natural shape of the breasts.

With further reference to FIG. 1, it may be observed that support means 52 is depicted. Support means takes the form of straps 54 and 56, which may be continuations of the respective corners of the pillow 32, such that there are no seams. Strap 54 connects to corners 44 and 50 of pillow 32, while strap 56 connects to corners 42 and 46 of pillow 32. Such structure permits straps 54 and 56 to criss-cross on the back 58 of subject 16, FIGS. 3 and 4. In addition, curved side portions 36 and 38 underlie breasts 18 and 20 of bust 12. Such under lying of breasts 18 and 20 provides support thereto. In addition, the entire side portions 36 and 38 separate breasts 18 and 20 from one another when used while a subject is sleeping, engaged in an athletic activity, and the like.

The four points of connection of the adjustable straps 54, 56 to the corners 44, 46, 48, and 50 of the pillow 32 enable X and Y spatial adjustment of the pillow on the torso for optimal fit and comfort. The positioning of the straps 54, 56 at the extreme corners 44, 46, 48, and 50 of the pillow 32 cause the back of the pillow to be retained comfortably against the woman's torso, for superior support between and around the inside curvature of the breasts, and prevents the pillow from riding up or away from the breasts, even at the corners.

Turning now to FIG. 2, another embodiment 10B of the present invention is shown. Embodiment 10B includes pillow 32 and the identical components of the same as indicated in FIG. 1. However, support means 60 is shown and includes a pair of Velcro fasteners 62. Velcro fasteners 62, in hook and loop format, attach one to outer surface 24 of casing 22 and the other to a garment 64, shown in portion. Garment 64 may take the form of a sports bra, a brassiere, a shirt, and the like. In any case, Velcro fasteners 62 are positioned on casing 22 such that pillow 32 is placed between breasts 18 and 20 in the same manner as that depicted in FIG. 3. Of course other fasteners may be employed such as adhesive, snaps, magnets, and the like.

Figure 3:
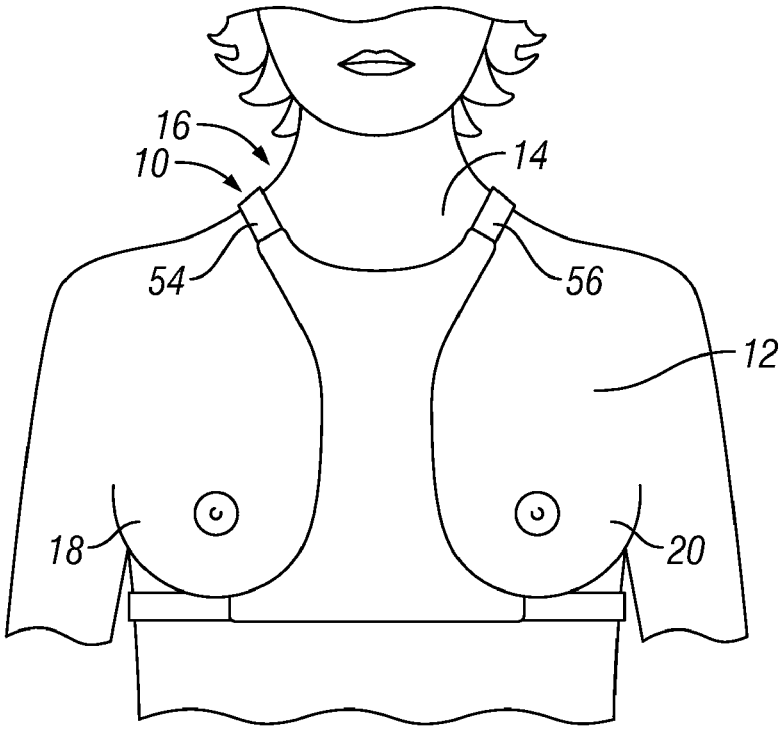
FIG. 3 is a front elevational view of a subject utilizing the embodiment of the invention depicted in FIG. 1.
Figure 4:
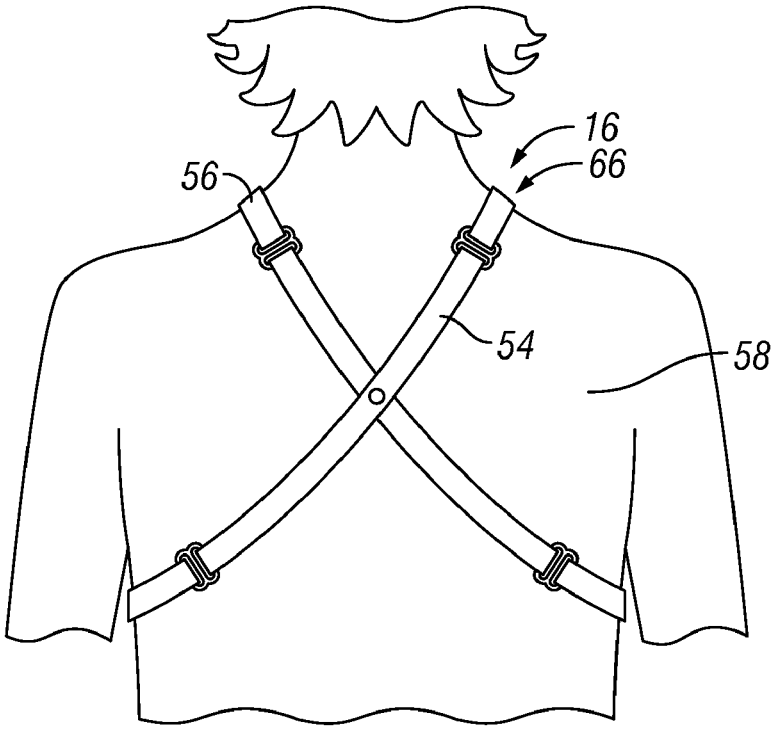
FIG. 4 is a rear elevational view of a subject utilizing the embodiment of the present invention depicted in FIG. 1.

In operation, the user places support device 10A or 10B between breasts 18 and 20 of bust 12 as shown in FIG. 3. Support means 52 in the form of criss-crossing straps 54 and 56 are employed to hold support device 10A directly to the torso 14 of the subject 16. Such support takes the form of criss-crossing straps 54 and 56 on the back 58 of subject 16. Quartet of clasps 66 permits adjustment of straps 54 and 56 in the conventional manner. In the alternative, embodiment 10B, FIG. 2, is employed with a garment 64 such that pillow 32 is placed between breasts 18 and 20 of the user, and attached to an overlying garment 64 such as a sports bra, brassiere, shirt, and the like, by support means 60.

The casing, straps, and other components of the inventive device may be assembled by glue or other adhesive to reduce or eliminate seams in the construction.

The criss-cross arrangement of the straps also prevents circulation blockage and facilitates lymphatic drainage. The inventive device may also be used as a pillow for post-surgery recovery by heart patients and the like. Furthermore, the inventive pillow may be used for support and comfort during massage treatments.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A support device for the bust on the torso of a subject, comprising:

a pillow, said pillow including a casing forming a chamber for accommodating a filler occupying said casing chamber, said pillow including a top, left and right curved side portions oriented to curve in opposite orientation from one another, and a bottom, said left and right curved side portions connected to said top and bottom to form the perimeter of said pillow, said bottom and top being substantially wider than the narrowest width between said left and right curved side portions, said bottom extending along said perimeter to enable a part of each of said left and right side portions to underlie the bust of the subject when said pillow is placed in the cleavage area of the bust, a first corner at the juncture of said left curved side portion and said top, a second corner at the juncture of said right curved side portion and said top, a third corner at the juncture of said left curved side portion and said bottom, and a fourth corner at the juncture of said right curved side portion and said bottom; and support means for holding said pillow to the cleavage area of the bust, said support means comprising a first strap extending from said first corner to said fourth corner, and a second strap extending from said second corner to said third corner.

2. The device of claim 1 in which said first and second straps connect to said pillow to permit said first and second straps to criss-cross one another at the rear portion of the torso of the subject.

3. The device of claim 2 which additionally comprises means for adjusting the length of said first and second straps.

4. A bust support device useable with a garment overlying at least a portion of the torso of a subject comprising:

a pillow, said pillow including a casing having an outer surface and an inner surface, said casing forming a chamber for accommodating a filler occupying said casing chamber said pillow including left and right curved side portions oriented to curve in opposite orientation from one another, and a bottom, said left and right curved side portions connecting to said top and bottom to form the perimeter of said pillow, said bottom and top being substantially wider than the narrowest width between said left and right curved side portions, said bottom extending along said perimeter to enable a part of each of said left and right side portions to underlie the bust of the subject when said pillow is placed in the cleavage area of the bust, a first corner at the juncture of said left curved side portion and said top, a second corner at the juncture of said right curved side portion and said top, a third corner at the juncture of said left curved side portion and said bottom, and a fourth corner at the juncture of said right curved side portion and said bottom; and support means for holding said pillow to the garment at the cleavage area of the bust, said support means comprising a first strap extending from said first corner to said fourth corner, and a second strap extending from said second corner to said third corner.

5. The device of claim 4 wherein said support means comprises at least one releasable fastener.

* * * * *